US009676584B2

(12) United States Patent
Takemasa

(10) Patent No.: US 9,676,584 B2
(45) Date of Patent: Jun. 13, 2017

(54) SHEET PROCESSING APPARATUS AND IMAGE FORMING APPARATUS

(71) Applicant: CANON KABUSHIKI KAISHA, Tokyo (JP)

(72) Inventor: Rikiya Takemasa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 150 days.

(21) Appl. No.: 14/282,278

(22) Filed: May 20, 2014

(65) Prior Publication Data

US 2014/0363265 A1 Dec. 11, 2014

(30) Foreign Application Priority Data

Jun. 11, 2013 (JP) ..... 2013-122652

(51) Int. Cl.

| | |
|---|---|
| ***B65H 31/34*** | (2006.01) |
| ***B65H 31/02*** | (2006.01) |
| ***B65H 31/30*** | (2006.01) |
| ***B65H 31/38*** | (2006.01) |

(52) U.S. Cl.

CPC ..... *B65H 31/34* (2013.01); *B65H 31/02* (2013.01); *B65H 31/3081* (2013.01); *B65H 31/38* (2013.01); *B65H 2301/4212* (2013.01); *B65H 2301/4213* (2013.01); *B65H 2801/27* (2013.01)

(58) Field of Classification Search

CPC ..... B65H 31/34; B65H 31/28; B65H 31/30; B65H 31/309; B65H 31/3081; B65H 9/00; B65H 2301/36; B65H 2301/3613; B65H 2301/363

USPC ..... 270/58.12, 58.17, 58.27

See application file for complete search history.

(56) References Cited

U.S. PATENT DOCUMENTS

| | | | | |
|---|---|---|---|---|
| 5,762,328 | A | 6/1998 | Yamada et al. | |
| 6,290,220 | B1 * | 9/2001 | Takehara | B42C 1/12 270/58.08 |
| 6,371,472 | B1 * | 4/2002 | Miyake | B42C 1/12 270/58.08 |
| 7,207,556 | B2 * | 4/2007 | Saitoh | B65H 31/40 227/110 |
| 7,389,980 | B2 * | 6/2008 | Kushida | B65H 9/06 270/58.12 |
| 7,607,652 | B2 * | 10/2009 | Kushida | B65H 9/06 270/58.12 |

(Continued)

FOREIGN PATENT DOCUMENTS

| | | |
|---|---|---|
| JP | 9-52654 A | 2/1997 |
| JP | 3466376 B2 | 8/2003 |

*Primary Examiner* — Leslie A Nicholson, III

(74) *Attorney, Agent, or Firm* — Fitzpatrick, Cella, Harper & Scinto

(57) ABSTRACT

A sheet processing apparatus includes a controller configured to control operations of the pair of aligning members such that a sheet bundle disposed on a first stacking portion is aligned by the pair of aligning members of the pair of aligning members at a position shifted to a side of one aligning member in a width direction perpendicular to the discharge direction of a sheet with respect to a sheet discharge range in which a sheet is discharged at the time of discharging the sheet from a discharge portion, and, before the aligned sheet bundle is discharged to a second stacking portion by a bundle discharge portion, the other aligning member of the pair of aligning members is moved to the outside of the sheet discharge range in the width direction.

18 Claims, 15 Drawing Sheets

(56) References Cited

U.S. PATENT DOCUMENTS

| | | | |
|---|---|---|---|
| 2013/0341856 | A1 | 12/2013 | Takemasa et al. |
| 2014/0015188 | A1 | 1/2014 | Tokuma et al. |

* cited by examiner

SHEET PROCESSING APPARATUS AND IMAGE FORMING APPARATUS

BACKGROUND OF THE INVENTION

Field of the Invention

The present invention relates to a sheet processing apparatus that processes a sheet on which an image is formed and an image forming apparatus including the sheet processing apparatus.

Description of the Related Art

Recently, a sheet processing apparatus has been proposed in which a sheet or a sheet bundle acquired by piling a plurality of sheets on which images are formed is once discharged to a processing tray so as to be aligned and is stapled and then, is discharged to a stack tray by a discharge belt to which projections are attached (U.S. Pat. No. 5,762,328).

In the sheet processing apparatus disclosed in U.S. Pat. No. 5,762,328, after a sheet or a bundle of sheets that is discharged to the processing tray and is aligned in the width direction intersecting the discharge direction of a sheet by one pair of aligning plates is discharged to the stack tray by the discharge belt to which projections are attached, the next sheet is discharged to the processing tray.

In addition, in the sheet processing apparatus disclosed in U.S. Pat. No. 5,762,328, when the sheet bundle is moved by the discharge belt, the sheet bundle is moved by the discharge belt while both end portions of the sheet bundle in the width direction are pressed by one pair of aligning plates so as not to allow the sheets to deviate from each other during the movement.

In addition, in the case of a job in which a plurality of sheet bundles is consecutively discharged to a stack tray, so-called offset discharge is known in which a sheet bundle on a processing tray is moved from the center in the width direction to one side or the other side by a predetermined amount by aligning plates, and then, the sheet bundle is discharged to the stack tray.

However, in order to perform the offset discharge by connecting the above-described sheet processing apparatus to an image forming apparatus having high productivity, any one of the aligning plates is in a discharge range of a sheet to be discharged to the processing tray. Accordingly, unless the discharge of a preceding sheet bundle has been completed, the aligning plate cannot be moved to a retraction position that is used for receiving the next sheet. Therefore, in order to save a retraction time for moving the aligning plate to the retraction position, the productivity has to be lowered, and accordingly, an operation of discharging a sheet to the processing tray, and an operation of aligning a sheet on the processing tray are inefficient.

SUMMARY OF THE INVENTION

It is desirable to provide a sheet processing apparatus capable of improving sheet processability.

According to the present invention, there is provided a sheet processing apparatus that includes: a discharge portion configured to discharge a sheet; a first stacking portion on which the sheet discharged by the discharge portion is stacked; a pair of aligning members configured to move in a width direction perpendicular to a discharge direction of the sheet and align the sheet on the first stacking portion in the width direction; a bundle discharge portion configured to discharge a sheet bundle having a plurality of sheets discharged on the first stacking portion; a second stacking portion on which the sheet bundle discharged by the bundle discharge portion is stacked; and a controller configured to control operations of the pair of aligning members such that the sheet bundle disposed on the first stacking portion is aligned by the pair of aligning members at a position shifted to a side of one aligning member of the pair of aligning members in the width direction with respect to a sheet discharge range in which a sheet is discharged at the time of discharging the sheet from the discharge portion, and, before the aligned sheet bundle is discharged to the second stacking portion by the bundle discharge portion, the other aligning member of the pair of aligning members is moved to the outside of the sheet discharge range in the width direction as the main configuration.

Further features of the present invention will become apparent from the following description of exemplary embodiments with reference to the attached drawings.

DESCRIPTION OF THE EMBODIMENTS

Hereinafter, exemplary embodiments of the present invention will be described in detail with reference to the drawings. However, the dimension, the material, and the shape of each constituent component described in the following embodiments and relative arrangements and the like thereof should be appropriately changed according to the configuration and various conditions of an apparatus to which the present invention is applied. Accordingly, unless otherwise specified, the scope of the present invention is not intended to be limited thereto.

Figure 1:
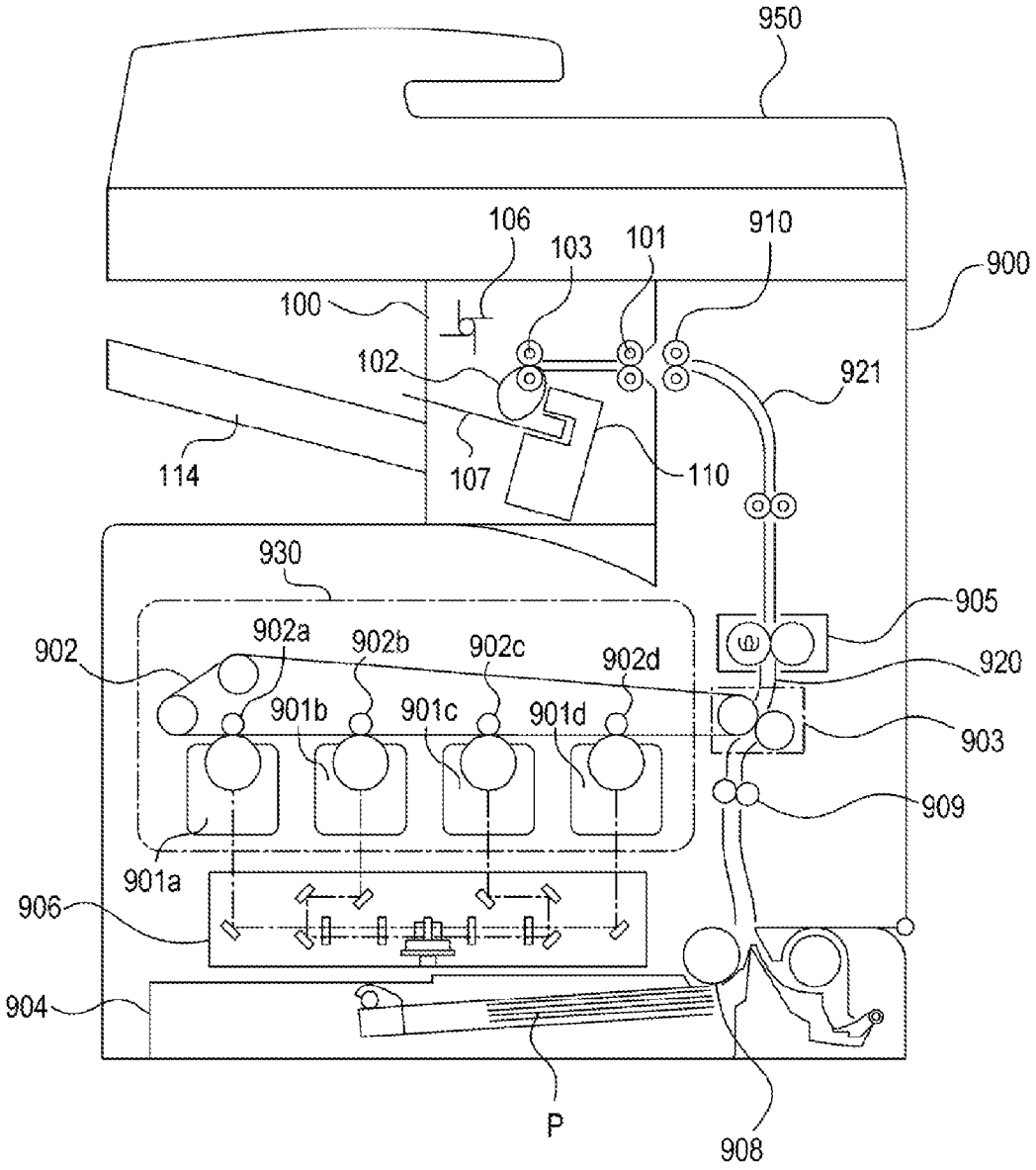
FIG. 1 is a cross-sectional view that schematically illustrates an image forming apparatus.

(Image Forming Apparatus) FIG. 1 is a main cross-sectional view of an image forming apparatus 900 that includes an automatic original feeding device 950 and a finisher 100. As illustrated in FIG. 1, an image forming apparatus 930, for example, includes photosensitive drums a (yellow), b (magenta), c (cyan), and d (black) that are four image bearing members forming toner images of colors including yellow, magenta, cyan, and black. These four photosensitive drums a to d are arranged to be parallel to each other. The image forming apparatus 930 includes an intermediate transfer belt 902 that is a transfer convey portion above the photosensitive drums a to d in a form vertically traversing the photosensitive drums.

Around each one of the photosensitive drums a, b, c, and d that are driven by a motor not illustrated in the figure, a primary charger, a development device, and a transfer charger, which are not illustrated in the figure, are arranged and are formed as a unit as one of process cartridges 901*a* to 901*d* that are detachably attachable to the image forming apparatus. In addition, below the photosensitive drums a to d, an exposure device 906 that is configured by a polygon mirror or the like is arranged. An image forming portion that forms an image on a sheet is configured by the photosensitive drum and the primary charger, the development device, and the like, which are not illustrated in the figure, acting on the photosensitive drum.

First, on the photosensitive drum a, a laser beam according to an image signal of a yellow component color of an original is projected through a polygon mirror of the exposure device 906 or the like, whereby an electrostatic latent image is formed on the photosensitive drum a. A yellow toner is supplied to the photosensitive drum a on which the electrostatic latent image is formed from the development device and is developed, whereby the electrostatic latent image is visualized as a yellow toner image. This toner image arrives at a primary transfer portion at which the photosensitive drum a and the intermediate transfer belt 902 abut each other according to the rotation of the photosensitive drum a. Then, according to a primary transfer bias applied to a transfer charger member 902*a*, a yellow toner image formed on the photosensitive drum a is transferred to the intermediate transfer belt 902 (primary transfer).

Until a portion bearing a yellow toner image of the intermediate transfer belt 902 arrives at a primary transfer portion at which the photosensitive drum b and the intermediate transfer belt 902 abut each other, a magenta toner image is formed on the photosensitive drum b using the same method as that described above. Then, this magenta toner image is transferred onto the intermediate transfer belt 902 from the yellow toner image at the primary transfer portion at which the photosensitive drum b and the intermediate transfer belt 902 abut each other. Similarly, as the intermediate transfer belt 902 moves, at primary transfer portions at which the photosensitive drums c and d abut the intermediate transfer belt 902, a cyan toner image and a black toner image are transferred on the yellow toner image and the magenta toner image described above in an overlapping manner.

Meanwhile, a sheet P is housed in a cassette 904 disposed on the lower side. The sheet P is sent by a pickup roller 908 one by one from the cassette 904, the timing of the sheet is adjusted by a resist roller 909, and the sheet P arrives at a secondary transfer portion. Then, at the secondary transfer portion, according to a secondary transfer bias applied to a pair of secondary transfer rollers 903, the four-color toner images formed on the intermediate transfer belt 902 are transferred onto the sheet P altogether (secondary transfer).

The sheet P onto which the four-color toner images have been transferred is conveyed to a pair of fixing rollers 905 with being guided by a conveyance guide 920 and is fixed by receiving heat and pressure therein. Accordingly, toners of colors are melted and mixed in color, whereby a full-color print image fixed to the sheet P is formed. Thereafter, the sheet P passes through a conveyance guide 921 and is conveyed to the finisher 100 by a pair of discharge rollers 910.

Next, the finisher 100 as the sheet processing apparatus will be described. As illustrated in FIG. 1, the finisher 100 includes a processing tray 107 that is a first stacking portion arranged on the upstream side in the sheet conveying direction and a stack tray 114 that is a second stacking portion arranged on the downstream side in the sheet conveying direction. The sheet P discharged from the pair of the main-body side discharge rollers 910 of the image forming apparatus main body 900 is conveyed inside the finisher 100, is selectively processed in the processing tray 107, and is stacked in the stack tray 114.

Modes of the process performed in the processing tray 107 include a sorting mode in which a plurality of sheets is sorted and a needle stitching (stapling) mode in which a plurality of sheets is bound by a stapling unit 110. The mode of the process is selected and set by a setting portion not illustrated in the figure before a job is started. In addition, needle stitching positions such as one-position stitching or two-position stitching can be selected, and the stapling unit 110 is moved to an actual needle stitching position based on the content of settings such as a sheet size and a stitching position, and needle stitching is performed for a predetermined position of a sheet bundle, and the sheet bundle is loaded into the stack tray 114.

<System Block Diagram>

Figure 2:
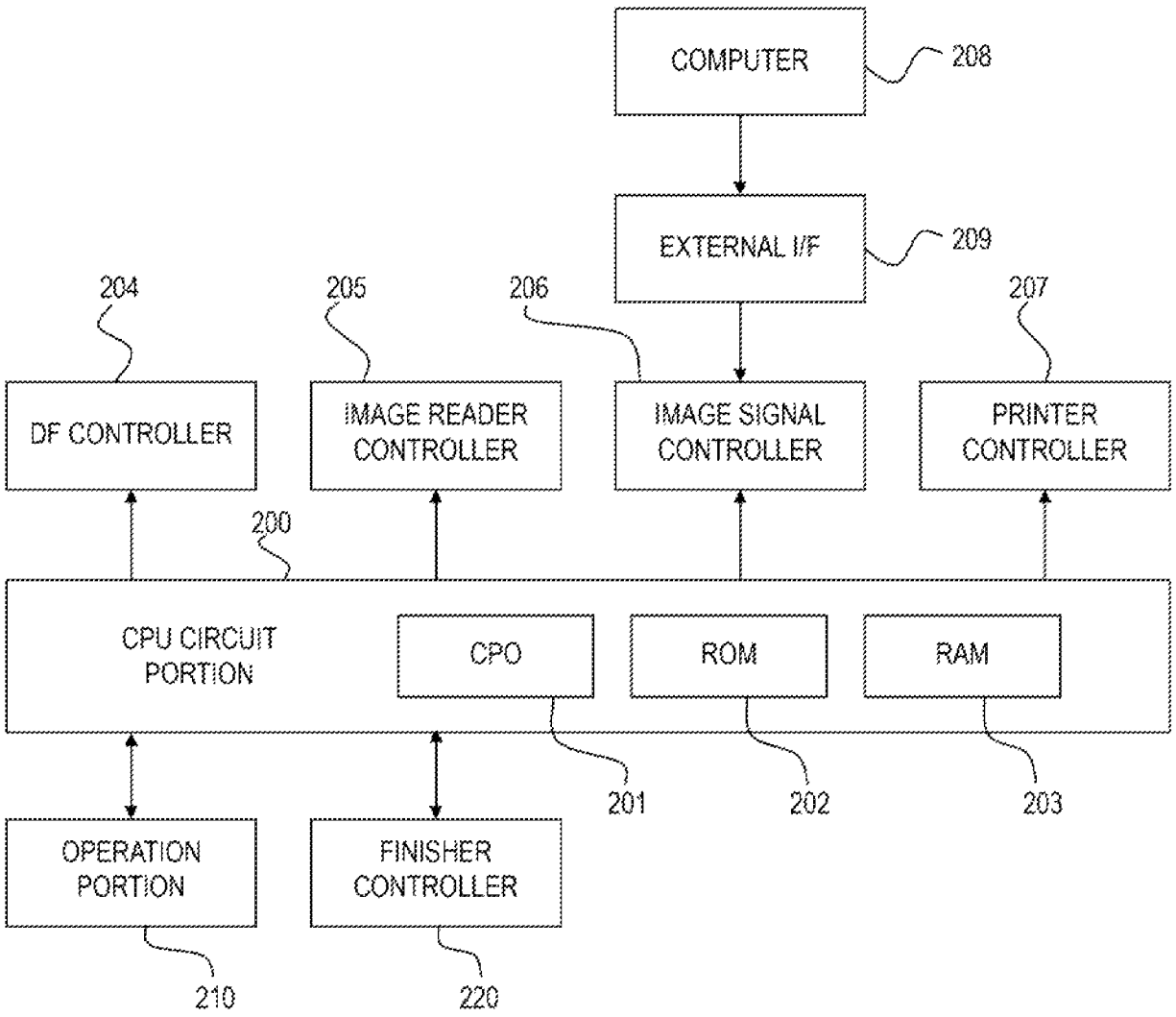
FIG. 2 is a block diagram of a controller of the image forming apparatus.

Next, the configuration of a controller that is responsible for the control of the entire image forming apparatus will be described with reference to FIG. 2. FIG. 2 is a block diagram of the controller that is responsible for the control of the entire image forming apparatus illustrated in FIG. 1. The controller includes a CPU circuit portion 200. The CPU circuit portion 200 has a CPU 201, ROM 202, and RAM 203 built therein and performs overall control of blocks 204, 205, 206, 207, 210, and 220 according to a control program stored in the ROM 202. The RAM 203 temporarily stores control data and is used as a work area of a calculation process accompanied with the control process.

A DF (original feed) controller 204 controls the driving of the original feeding device 950 based on an instruction supplied from the CPU circuit portion 200. An image reader controller 205 controls the driving of a scanner unit, an image sensor, and the like not illustrated in the figure, which are included in the original feeding device 950, and transmits an analog image signal output from the image sensor to an image signal controller 206.

The image signal controller 206 converts the analog image signal transmitted from the image sensor into a digital signal and then performs each process for the converted digital signal, converts the digital signal into a video signal, and outputs the video signal to a printer controller 207. In addition, the image signal controller 206 performs various processes for a digital image signal input from a computer 208 through an external I/F 209, converts the processed digital image signal into a video signal, and outputs the converted video signal to the printer controller 207. The process operation of the image signal controller 206 is controlled by the CPU circuit portion 200. The printer controller 207 drives the above-described exposure controlling portion based on the input video signal.

The operation portion 210 includes a plurality of keys used for setting various functions relating to image formation, a display portion used for displaying information representing a set state, and the like. The operation portion 210 outputs a key signal corresponding to the operation of each key to the CPU circuit portion 200 and displays corresponding information based on the signal transmitted from the CPU circuit portion 200.

The finisher controller 220 is mounted in the finisher 100 and exchanges information with the CPU circuit portion 200 of the image forming apparatus, thereby controlling the driving of the entire finisher. This finisher controller 220 controls various motors and sensors.

Figure 3:
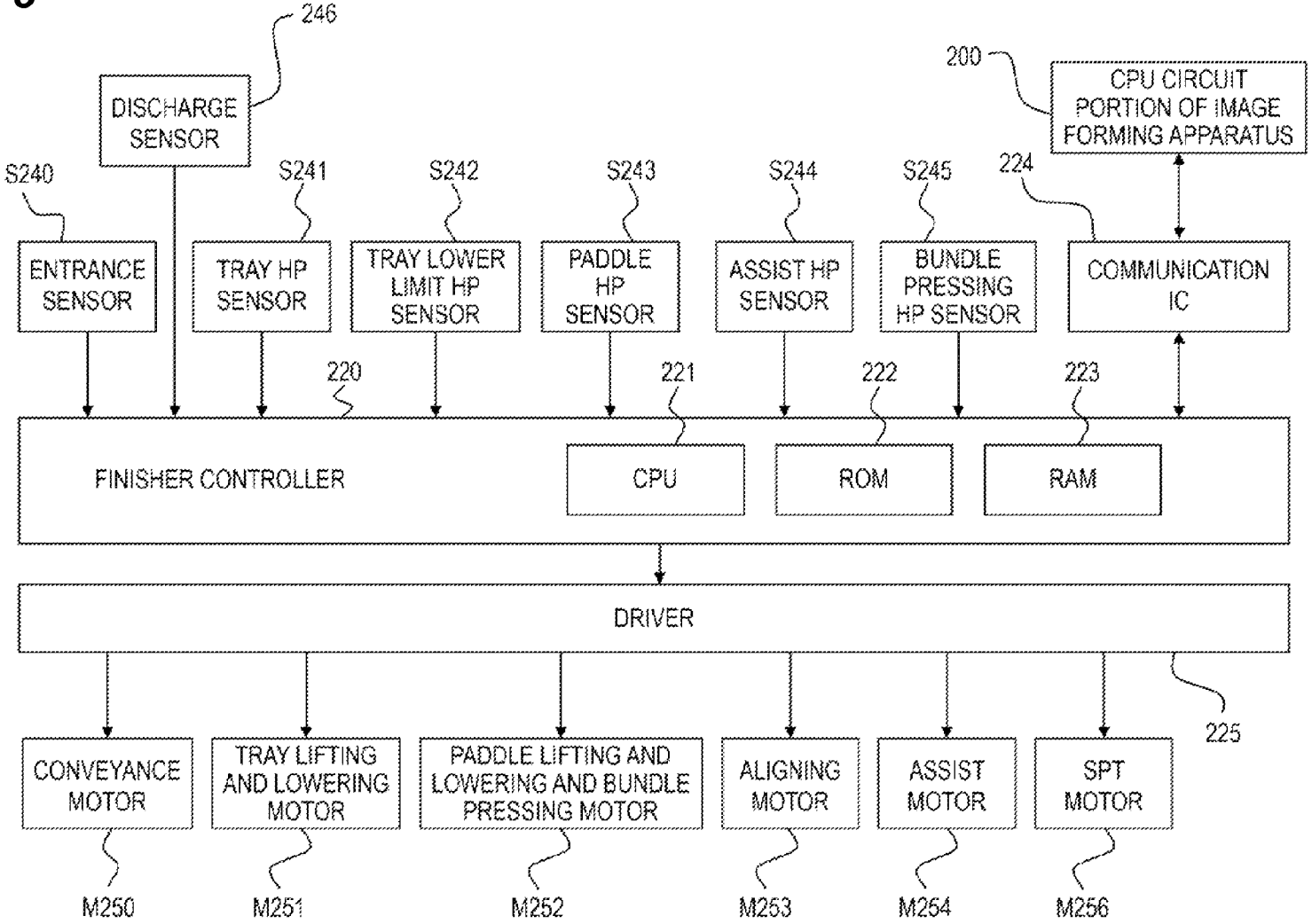
FIG. 3 is a block diagram of a finisher controller.

Next, the configuration of the finisher controller 220 that controls the driving of the finisher 100 will be described with reference to FIG. 3. The finisher controller 220 as a controller is configured by a CPU 221, ROM 222, RAM 223, and the like. The finisher controller 220 performs data exchange by communicating with the CPU circuit portion 200 disposed on the image forming apparatus main body side through a communication IC 224 and performs driving control of the finisher 100 by executing various programs stored in the ROM 222 based on an instruction supplied from the CPU circuit portion 200.

When such driving control is performed, detection signals are received by the finisher controller 220 from various sensors. As such various sensors, there are an entrance sensor 5240, a sheet face sensor 5241, a tray lower-limit sensor 5242, a paddle HP sensor 5243, an assist HP sensor 5244, and a bundle pressing HP sensor 5245. Based on a signal supplied from the finisher controller 220, the driver 225 drives a conveyance motor M250, a tray lifting and lowering motor M251, a paddle lifting and lowering/bundle pressing motor M252, an aligning motor M253, an assist motor M254, a stapling motor M256, and the like.

<Overview of Finisher>

Next, the finisher 100 as the sheet processing apparatus will be described with reference to FIGS. 4A, 4B, and 5.

<Processing Unit>

Figure 4A:
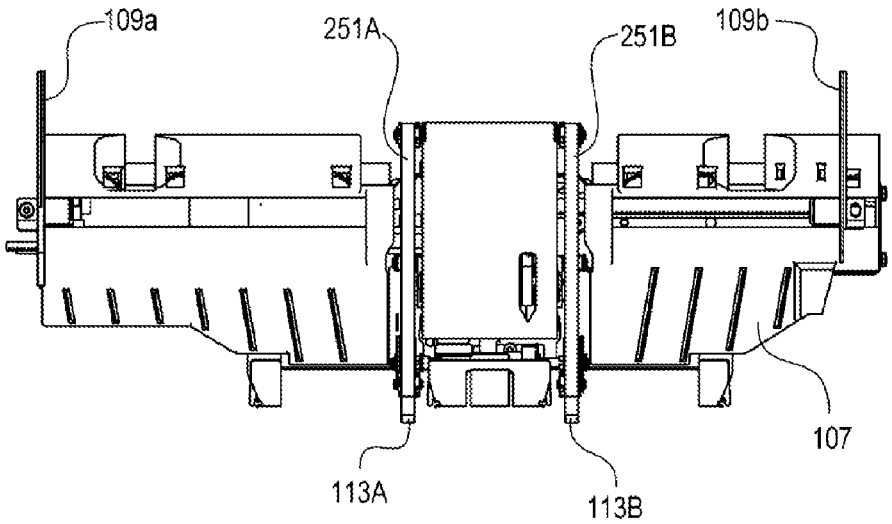
FIGS. 4A and 4B are plan views that illustrate processing units of a finisher.
Figure 4B:
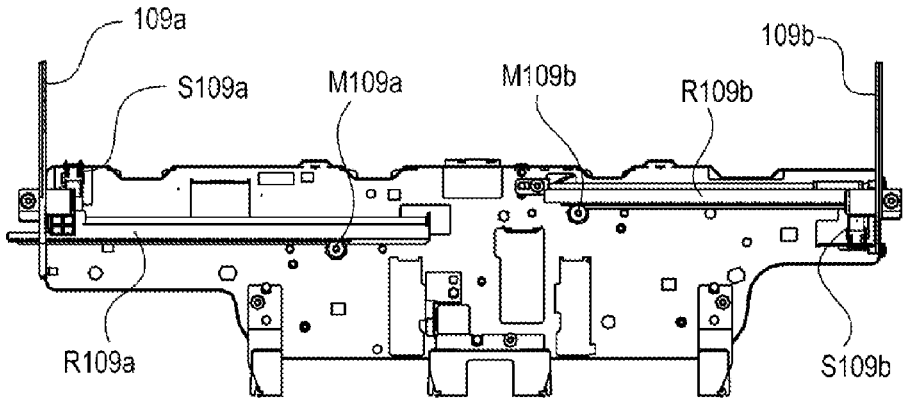

FIG. 4A is a top view of a processing tray portion, and FIG. 4B is a diagram that illustrates an aligning portion of the processing tray portion. FIG. 5 is a perspective view that illustrates a bundle discharge portion of the processing tray portion. As illustrated in FIGS. 4A and 4B, a front-side aligning member 109*a* and a rear-side aligning member 109*b* configuring a pair of aligning members as the aligning portion align end portions of the sheet, which is housed in the processing tray 107, in a width direction perpendicular to the sheet discharge direction. Here, the front side is a front side of the apparatus on which the operation portion of the image forming apparatus is disposed and is one side in the width direction of the sheet. On the other hand, the rear side is a rear face side of the apparatus that is the opposite side of the side on which the operation portion of the image forming apparatus is disposed and is the other side in the width direction of the sheet.

The aligning portion includes an aligning motor (an aligning motor M252 illustrated in FIG. 3) that can independently drive the aligning members 109*a* and 109*b* forming a pair on the front and rear sides in the sheet width direction. Thus, driving is delivered from front-end gears M109*a* and M109*b* of the aligning motor to rack gears R109*a* and R109*b* engaged with the front-end gears M109*a* and 109*b*, and the driving is delivered to the first and second aligning members 109*a* and 109*b* in which the rack gears R109*a* and 109*b* are disposed. Accordingly, the first and second aligning members 109*a* and 109*b* can independently move with respect to the processing tray 107 along the sheet width direction. Here, HP sensors S109*a* and S109*b* detecting home positions of the first and second aligning members 109*a* and 109*b* are arranged. When not operating, the first and second aligning members 109*a* and 109*b* stand by at the home positions thereof (both end portions of the processing tray 107 in the width direction).

Figure 5:
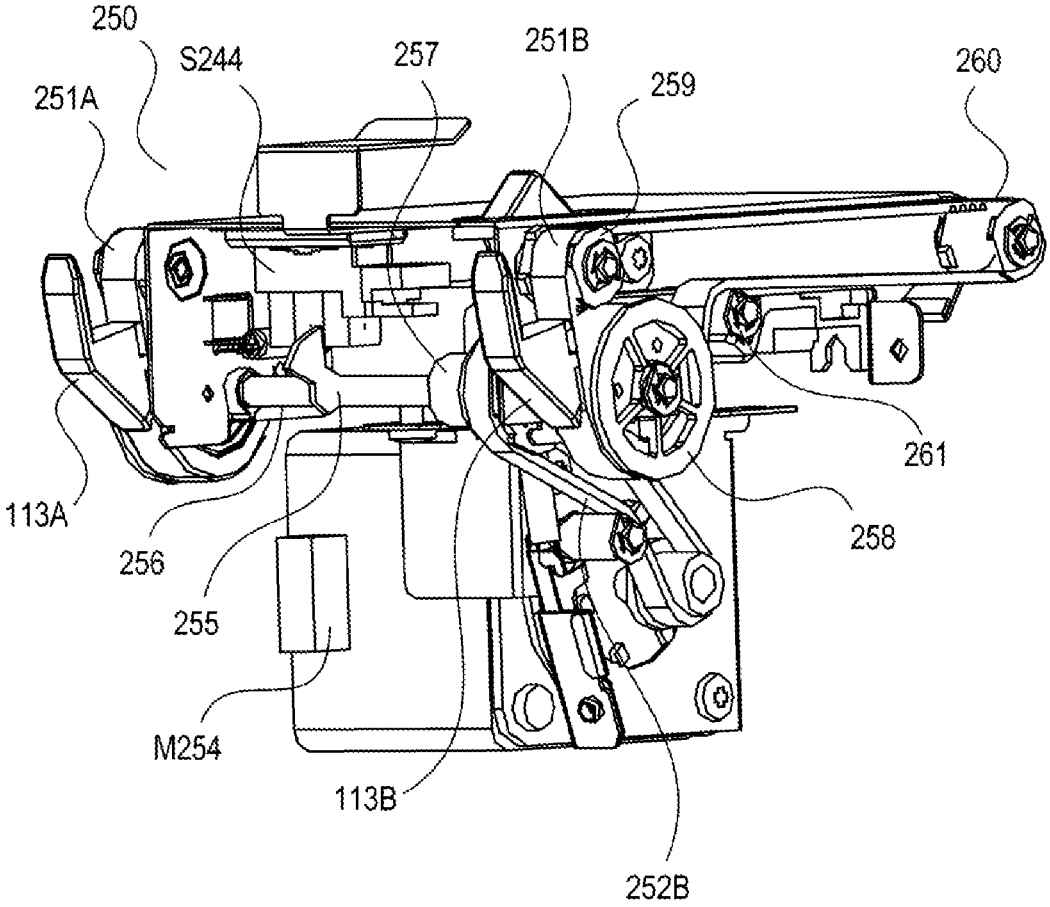
FIG. 5 is a perspective view that illustrates the processing unit of the finisher.

As illustrated in FIG. 5, discharge belts 251A and 251B configuring the bundle discharge portion 250 are stretched over pulleys 258, 259, 260, and 261 and include discharge projections 113A and 113B that are used for pressing the rear end of the sheet housed in the processing tray 107. By rotating the discharge belts 251A and 251B, the discharge projections 113A and 113B included in the discharge belts 251A and 251B push the rear end of the sheet housed in the processing tray 107, whereby the sheet is discharged to the stack tray 114. The discharge projections 113A and 113B configuring the bundle discharge portion 250 are disposed to be horizontally symmetric with respect to the center of the sheet discharge range 231 (see FIG. 14) of the sheet, which is discharged to the processing tray 107, in the width direction. Here, the sheet discharge range 231 in the width direction at the time of discharging the sheet using the discharge roller 103 is a range within the width of the sheet discharged according to the reference of the apparatus in the width direction. In this embodiment, the sheet conveyance center of the finisher 100 is set as the reference, and the sheet is conveyed with the center of the sheet in the width direction being adjusted to the reference. Here, while a configuration has been illustrated as an example in which the discharge projections 113A and 113B pressing the center portion of the rear end of the sheet in the width direction as the bundle discharge portion are arranged to be divided so as to be horizontally symmetric with respect to the center of the sheet discharge range 231 in the width direction, the configuration is not limited thereto. For example, as in a case where one bundle discharge member having horizontal symmetry is used or the like, a configuration may be employed in which the bundle discharge portion 250 is disposed at the center of the sheet, which is discharged to the processing tray 107, in the width direction.

The bundle discharge portion 250 includes the assist motor M254, and the driving is delivered from the front end pulley of the assist motor M254 to a connection shaft 256 through a timing belt 252B.

Here, the HP sensor 5244 detecting home positions of the discharge projections 113A and 113B is arranged. When not operating, the discharge projections 113A and 113B stand by at the home positions (the housing position of the processing tray 107). A detection flag 255 is disposed in the connection shaft 256, and the home positions of the discharge projections 113A and 113B are detected based on the detection of the detection flag 255 that is made by the HP sensor 5244.

<Sheet Discharging Operation>

Next, a sheet discharging operation of the finisher 100 according to this embodiment will be described with reference to FIGS. 6 to 14.

Figure 6:
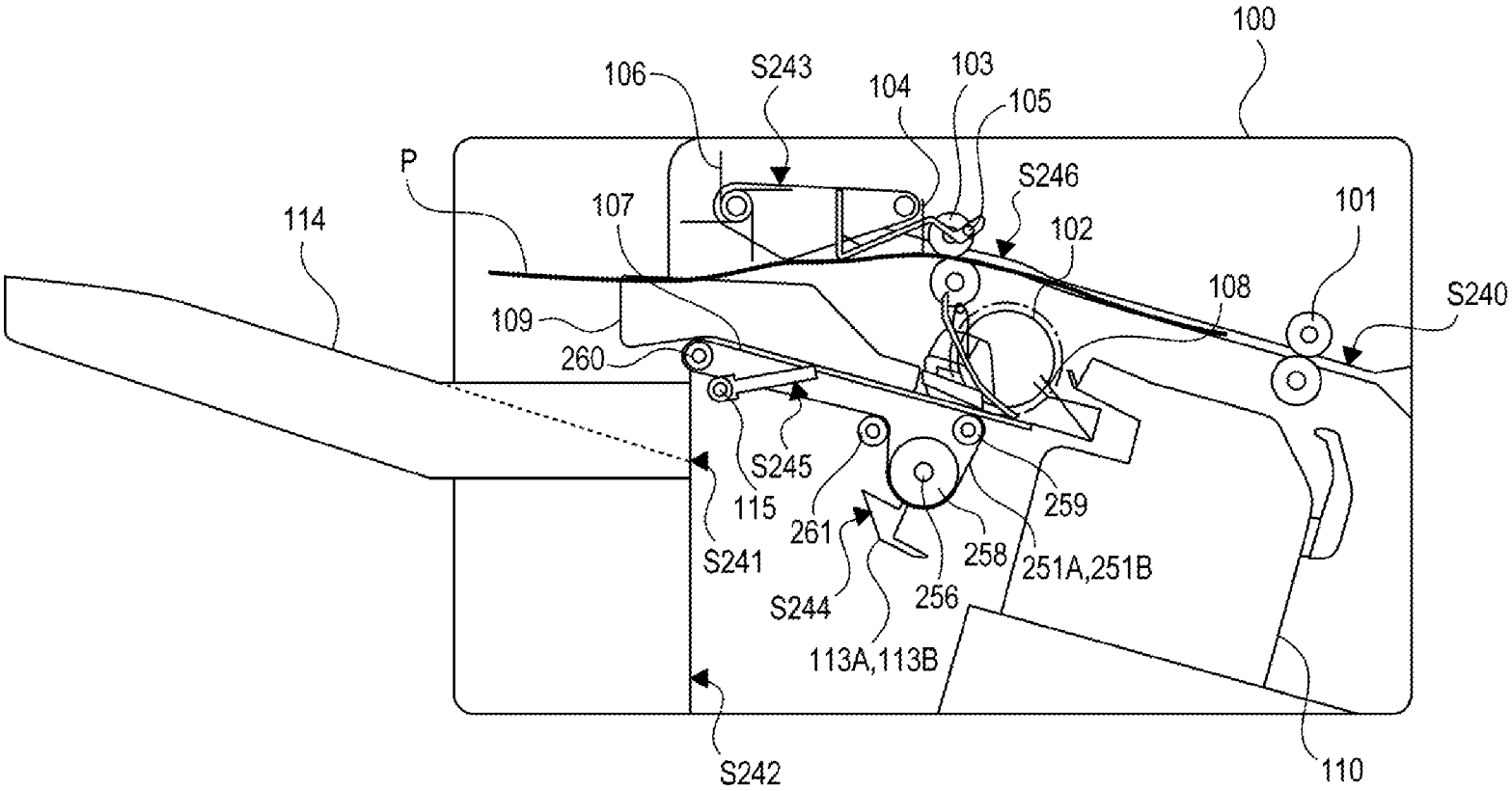
FIG. 6 is a cross-sectional view that illustrates a state in which a sheet is conveyed on a processing tray.

As illustrated in FIG. 6, a sheet P discharged from the image forming apparatus 900 is delivered to the entrance roller 101 of the finisher 100 that is driven by the conveyance motor M250 and is conveyed to the conveyance path arranged inside the finisher 100. At this time, the delivery timing of the front end of the sheet P is detected by the entrance sensor 5240 at the same time. The sheet P is delivered to the discharge roller (discharge portion) 103, and the front end portion thereof is conveyed while lifting a tail dropping portion 105. In addition, at the same time, the sheet is conveyed to the processing tray 107 while being neutralized by a charge removal needle 104. The sheet P discharged to the processing tray 107 by the discharge roller 103 is pressed from the upper side according to the self-weight of the tail dropping portion 105, whereby the time required for the rear end portion of the sheet P to fall to the processing tray 107 is shortened. Based on a signal of the rear end of the sheet P that is detected by the discharge sensor S246, the finisher controller 220 controls the inside of the processing tray.

Figure 7:
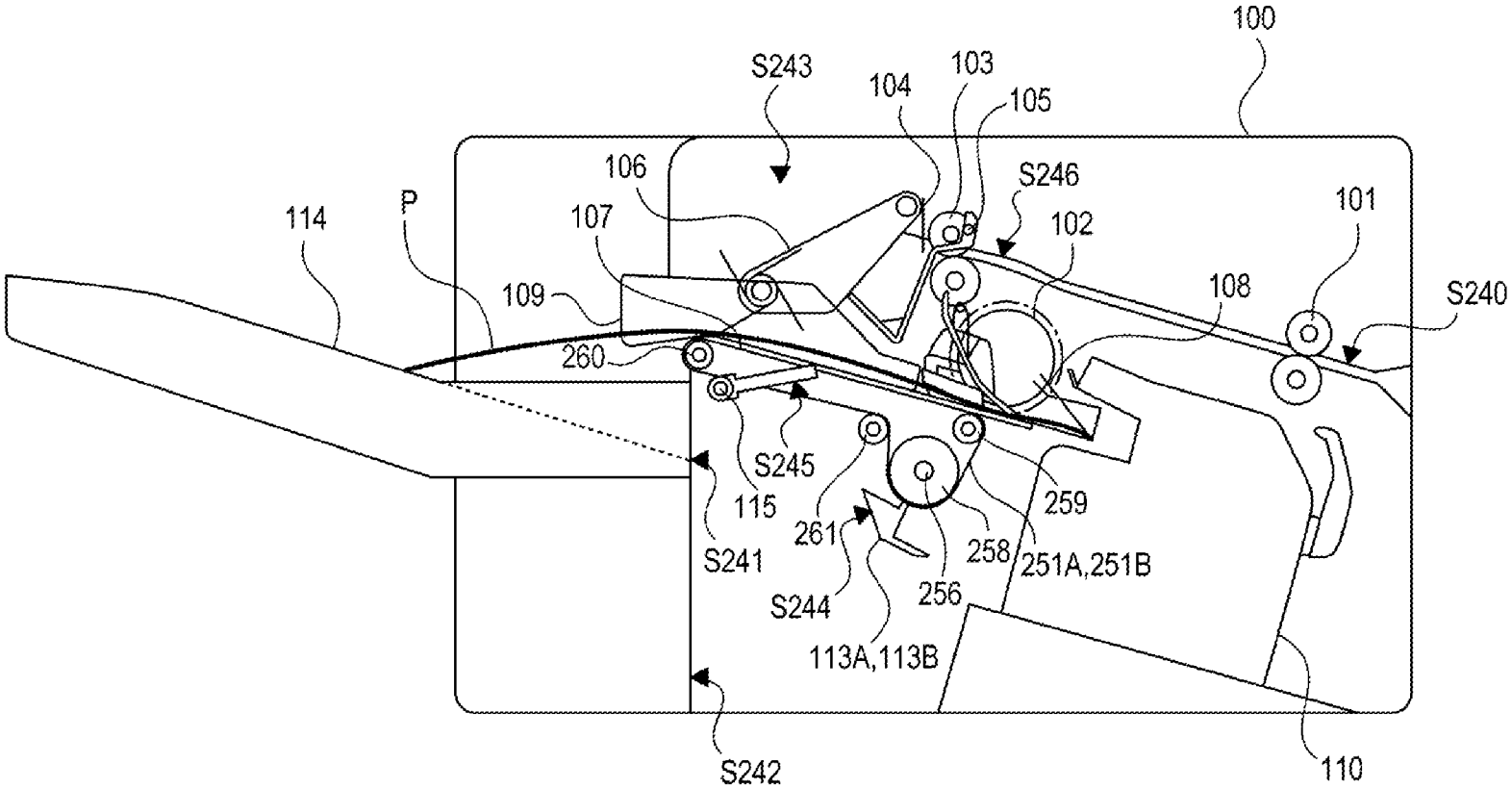
FIG. 7 is a cross-sectional view that illustrates a state in which a sheet is aligned on the processing tray.

As illustrated in FIG. 7, according to the rotation of the paddle lifting and lowering/bundle pressing motor M252 in one direction, a paddle 106 operates to be lowered to the processing tray 107 with the rotation axis being used as the center. In addition, the lifting operation of the paddle 106 and the bundle pressing operation of a bundle pressing portion 115 are driven by using the forward/reverse rotation of the paddle lifting and lowering/bundle pressing motor M252. Since the paddle 106 is rotated in the counterclockwise direction illustrated in the figure by the conveyance motor M250, as the paddle 106 is brought into contact with the sheet P, the sheet P is conveyed to the side of a rear end stopper 108 that is disposed on the right side in the figure. When the rear end of the sheet P is delivered to a knurled belt 102, the sheet is driven upward by the paddle lifting and lowering/bundle pressing motor M252. Then, when the sheet P is detected to have arrived at the HP by the paddle HP sensor 5243, the driving of the sheet is stopped. The knurled belt 102 conveys the sheet P conveyed by the paddle 106 to the rear end stopper 108 and then conveys the sheet P while slipping the sheet P, whereby the sheet P is constantly biased to the side of the rear end stopper 108. According to this slipped conveyance, the skew feeding of the sheet P can be corrected by causing the sheet P to collide with the rear end stopper 108, whereby the conveying direction of the sheet is aligned.

Figure 8:
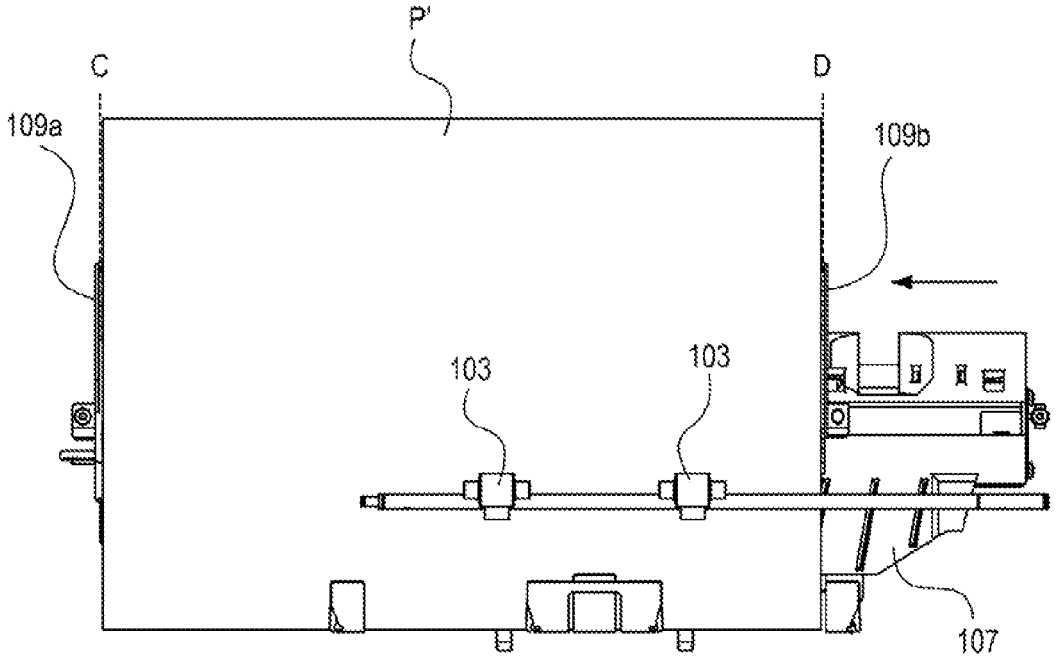
FIG. 8 is a plan view that illustrates a state in which a sheet is aligned on the processing tray.
Figure 9:
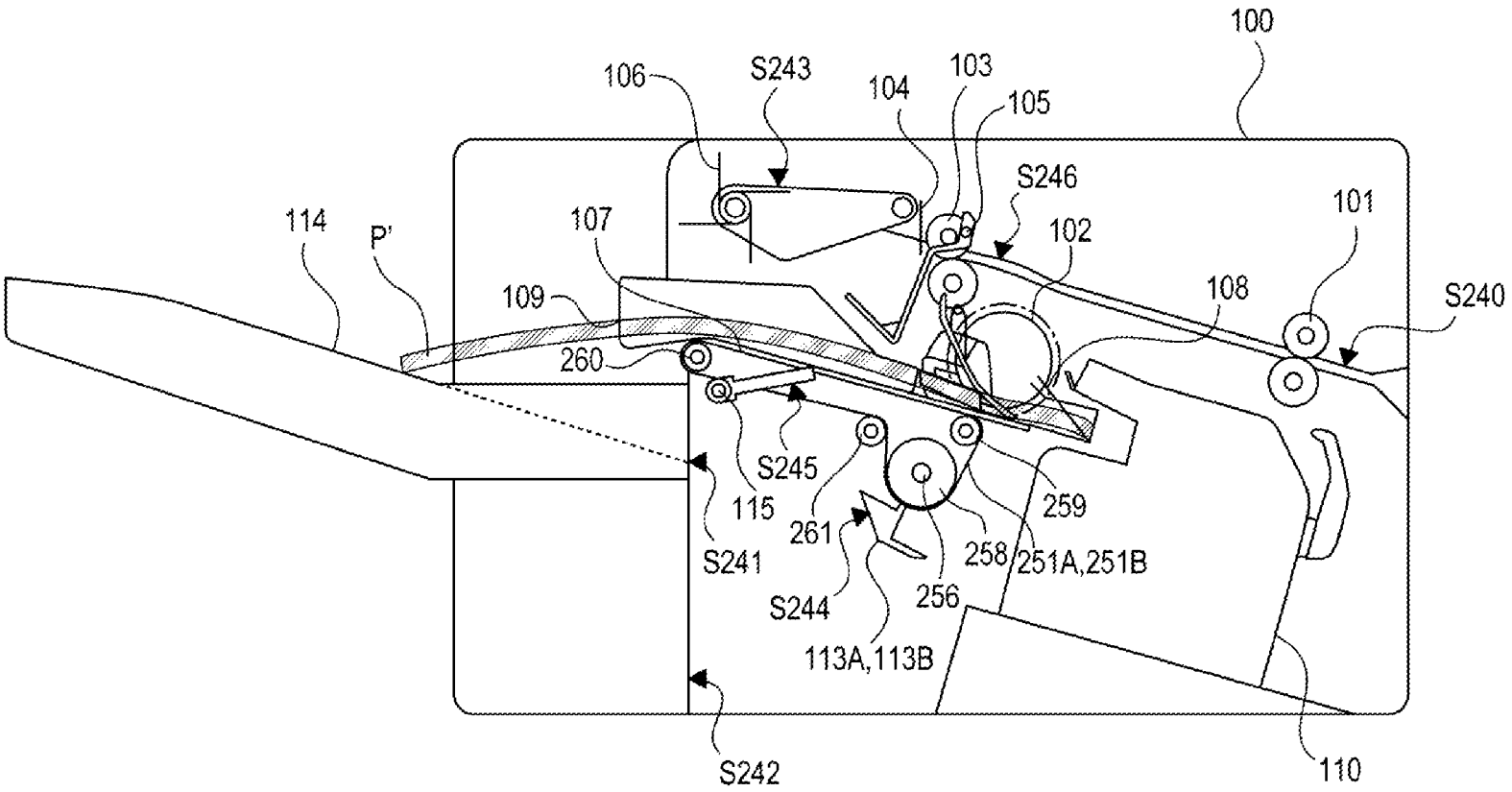
FIG. 9 is a cross-sectional view that illustrates a state in which a sheet is aligned on the processing tray.

The sheet P that has collided with the rear end stopper 108 is aligned in the sheet width direction of the sheet P at a shift position shifted from the center of the sheet discharge range 231 of the sheet in the width direction to the front side that is the side of the one aligning member out of the pair of aligning members. As illustrated in FIG. 8, the front-side aligning member 109*a* out of the pair of aligning members is caused to stand by at a position C offset to the front side from the sheet discharge position. Then, by moving the rear-side aligning member 109*b* in the direction toward the front-side aligning member 109*a* to collide with the sheet and moving up to a position D, aligning in the width direction is performed with the sheet being nipped therebetween. Accordingly, the sheet P is aligned in the width direction at the aligning position shifted from the center of the sheet discharge range 231 (sheet discharge position) in the width direction to the front side that is the side of the one aligning member. In addition, when the sheet P is nipped between the front-side aligning member 109*a* and the rear-side aligning member 109*b*, the rear-side aligning member 109*b* is located inside the sheet discharge range 231 of the sheet in the width direction. The aligning operations for the conveyance direction and the sheet width direction described above are repeatedly performed every time when the sheet P is conveyed until the job is completed, and a sheet bundle P' configured by a plurality of sheets is formed on the processing tray (FIG. 9).

Figure 10:
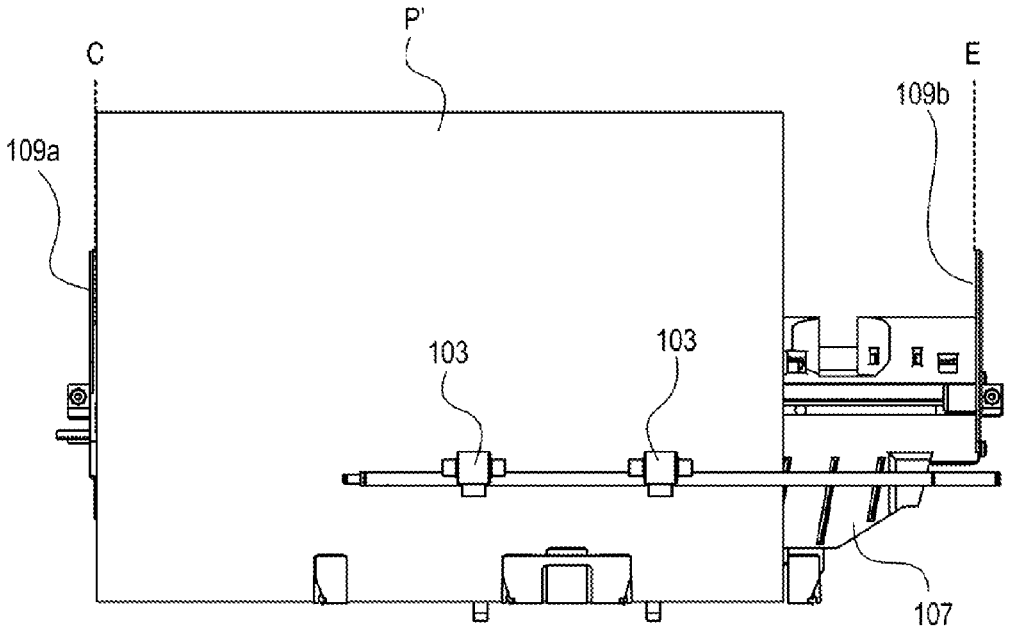
FIG. 10 is a plan view that illustrates a state in which a sheet is aligned on the processing tray.

When the sheet bundle P' is formed, as illustrated in FIG. 10, in a state in which the front-side aligning member 109*a* is caused to stand by at the position C shifted from the sheet discharge position to the front side, the rear-side aligning member 109*b* that is the other aligning member is moved to a standby position E outside the sheet discharge range 231 from the collision position D. Then, the rear-side aligning member 109*b* is caused to stand by until the aligning of the next sheet.

Figure 11:
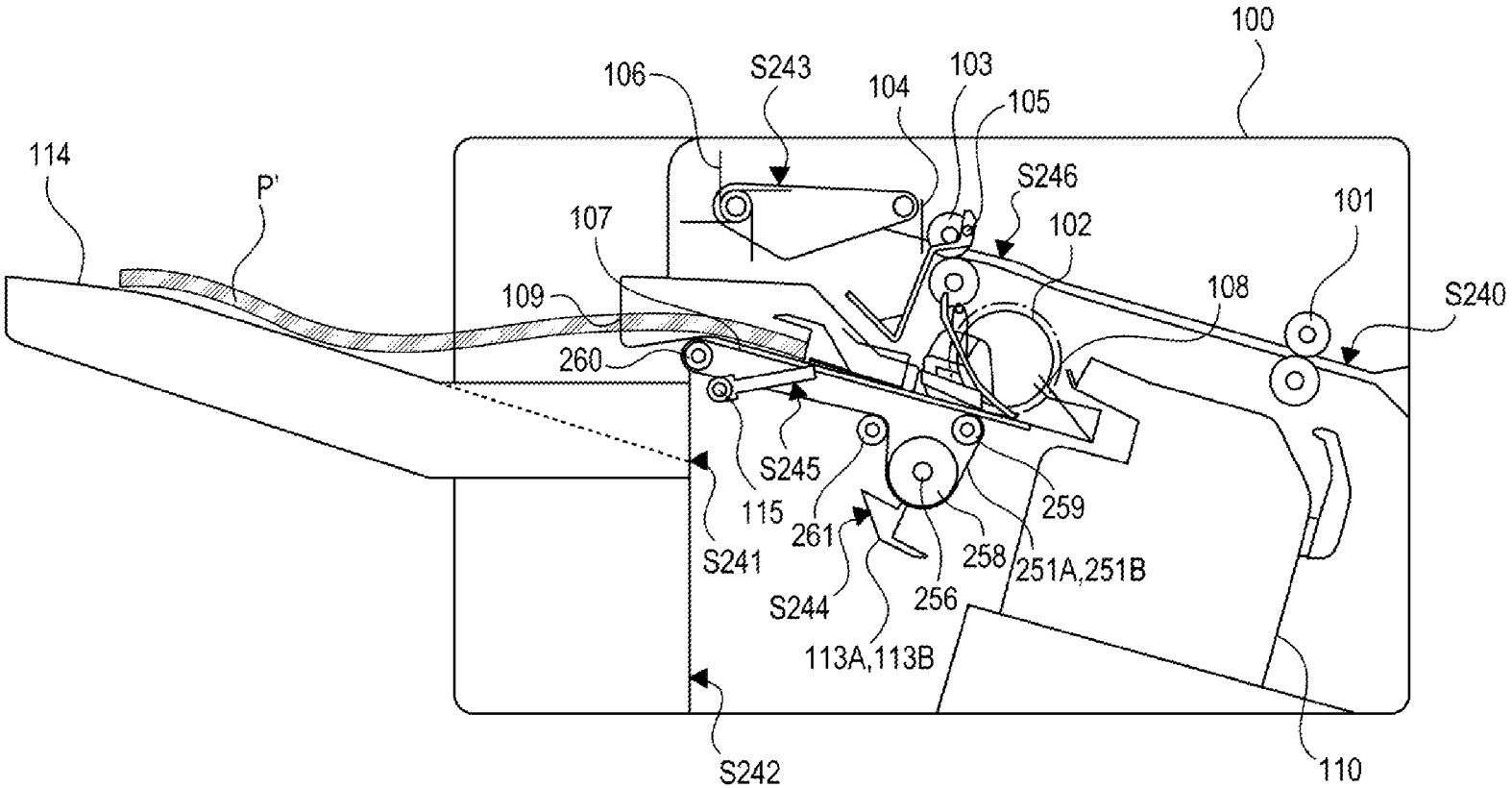
FIG. 11 is a cross-sectional view that illustrates a state in which a sheet is discharged from the processing tray.
Figure 12:
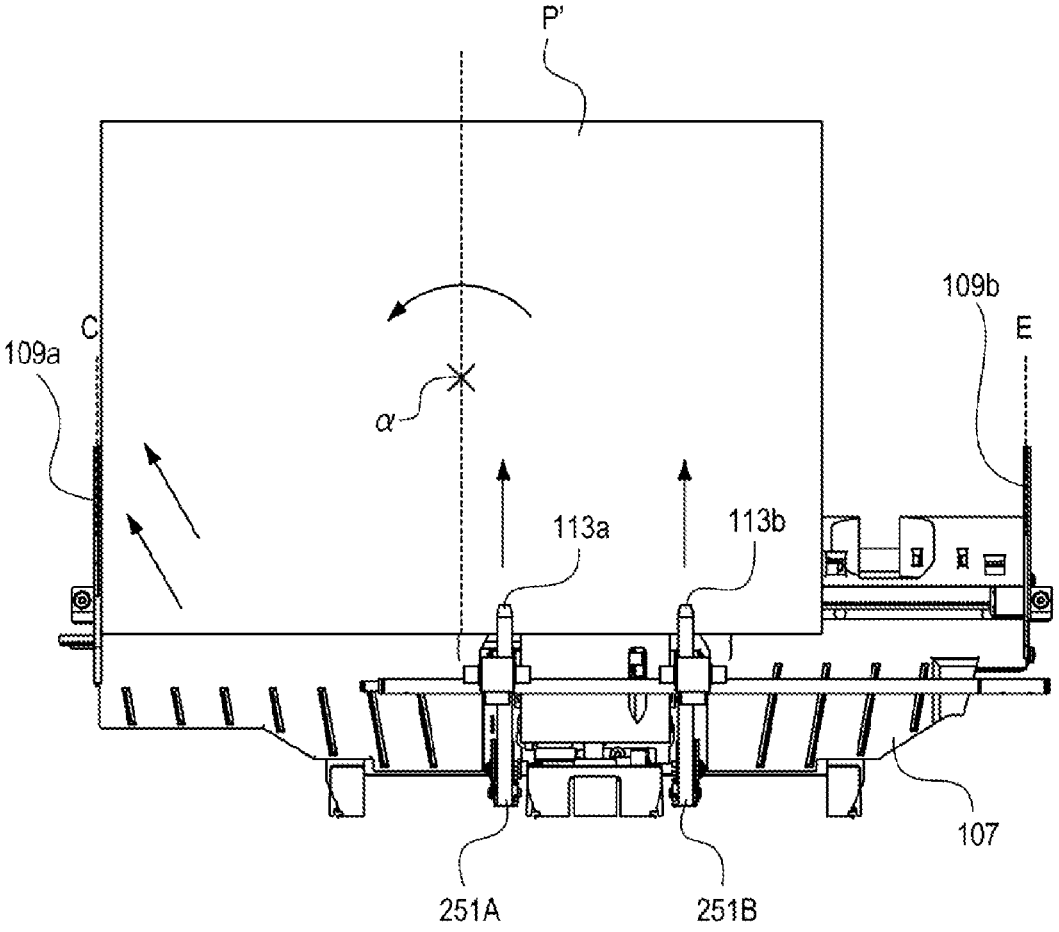
FIG. 12 is a plan view that illustrates a state in which a sheet is discharged from the processing tray.
Figure 14:
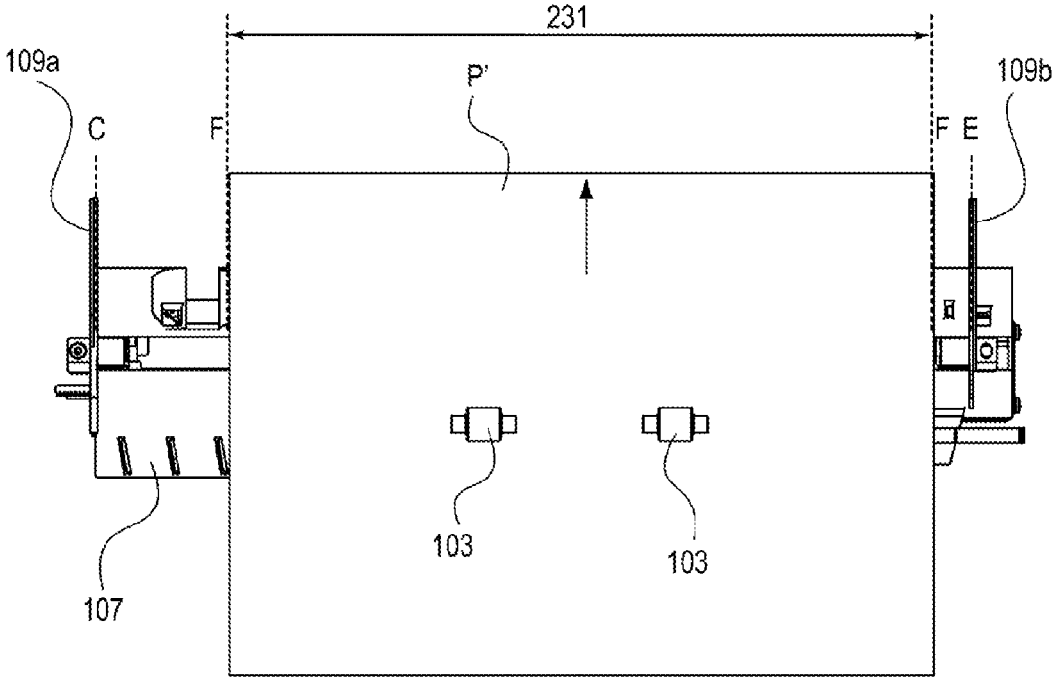
FIG. 14 is a plan view that illustrates a state in which the next sheet is discharged to the processing tray.

Thereafter, as illustrated in FIG. 11, the driving is delivered to the discharge belts 251A and 251B by the assist motor M254, and the rear end of the sheet bundle P' is pushed by the discharge projections 113A and 113B, whereby the sheet bundle P' disposed on the processing tray 107 is discharged as a bundle to the stack tray 114. At this time, as illustrated in FIG. 12, since the sheet bundle P' is aligned at a position offset from the center portion of the sheet discharge range 231 in the width direction to the apparatus front side (the side of the one aligning member), the rear-side rear end portions of the sheet bundle P' are pushed by the discharge projections 113A and 113B so as to be discharged. Accordingly, while force for inclination toward the direction of the front-side aligning member 109*a* that is the one aligning member is applied to the sheet bundle P' based on the relation with the center of gravity position a of the sheet, the front-side aligning member 109*a* stands by at the front-side position C that is the aligning position and regulates the position of the sheet bundle. Accordingly, the sheet bundle P' is discharged as a bundle to the stack tray 504 while being guided by the front-side aligning member 109*a*, whereby the bundle discharge is stabilized. Meanwhile, as illustrated in FIG. 14, also in a case where the next sheet P2 is discharged to the processing tray 107 by the discharge roller 103, before the front end of the sheet P2 abuts the processing tray 107 or the sheet loaded in the processing tray 107, the front-side aligning member 109*a* is retracted to the front-side standby position C, and the rear-side aligning member 109*b* is retracted to the rear-side standby position E. In other words, since the other (rear-side) aligning member out of the pair of aligning members is retracted to the outer side of the sheet discharge range 231 (between F-F) of the sheet P2, the next sheet can be efficiently discharged without waiting until the time required for retracting the aligning member.

Figure 13:
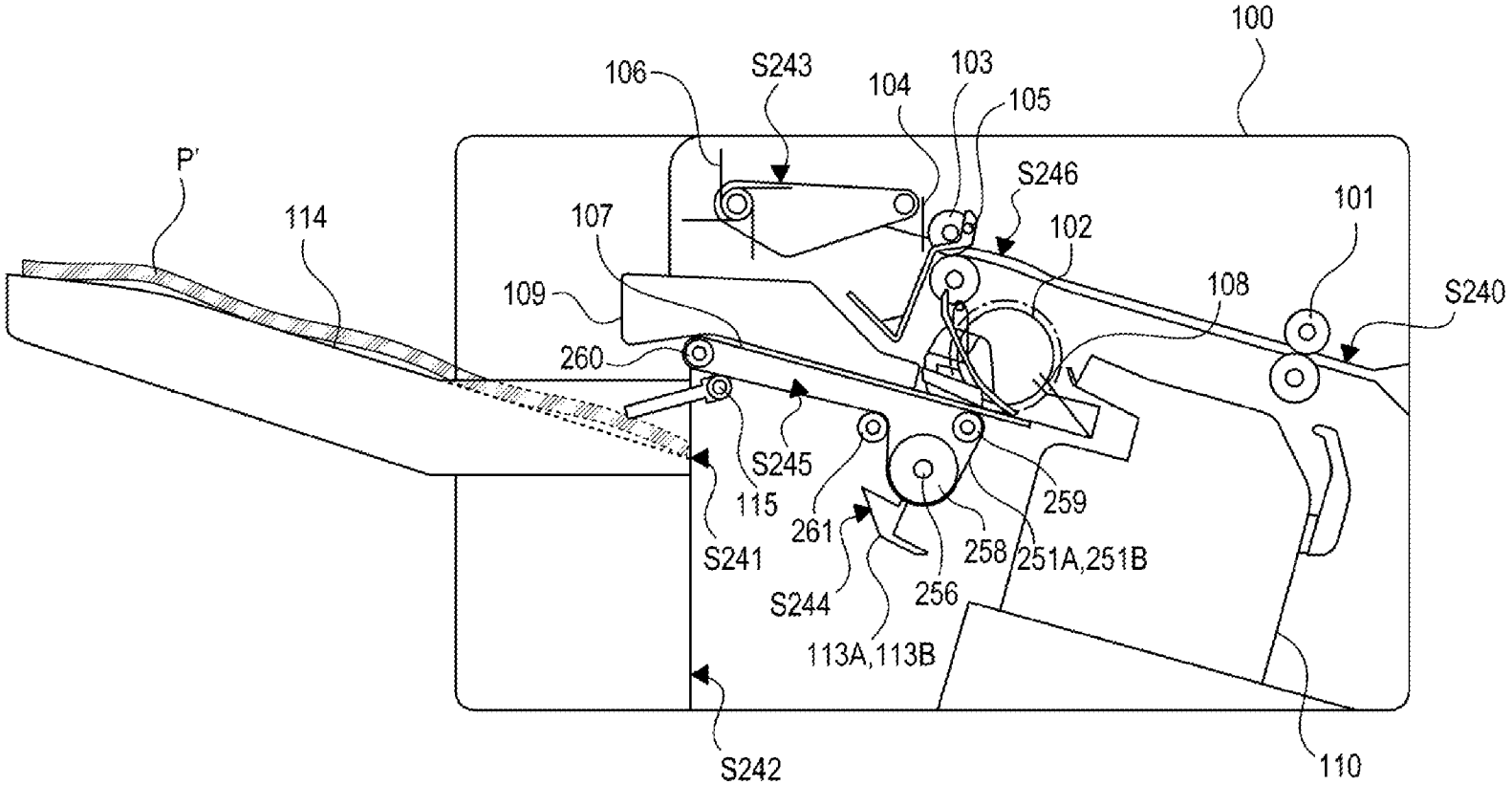
FIG. 13 is a cross-sectional view that illustrates a state in which a sheet is discharged to a stack tray.

Thereafter, as illustrated in FIG. 13, by the discharge projections 113A and 113B, the sheet bundle P' is discharged to the stack tray 114, and the bundle pressing portion 115 rotates in the counterclockwise direction in the figure and pushes the rear end portion of the sheet bundle P'.

By repeatedly performing a series of operations described until now, sheet bundles corresponding to a required number can be discharged to the stack tray 114.

Figure 15:
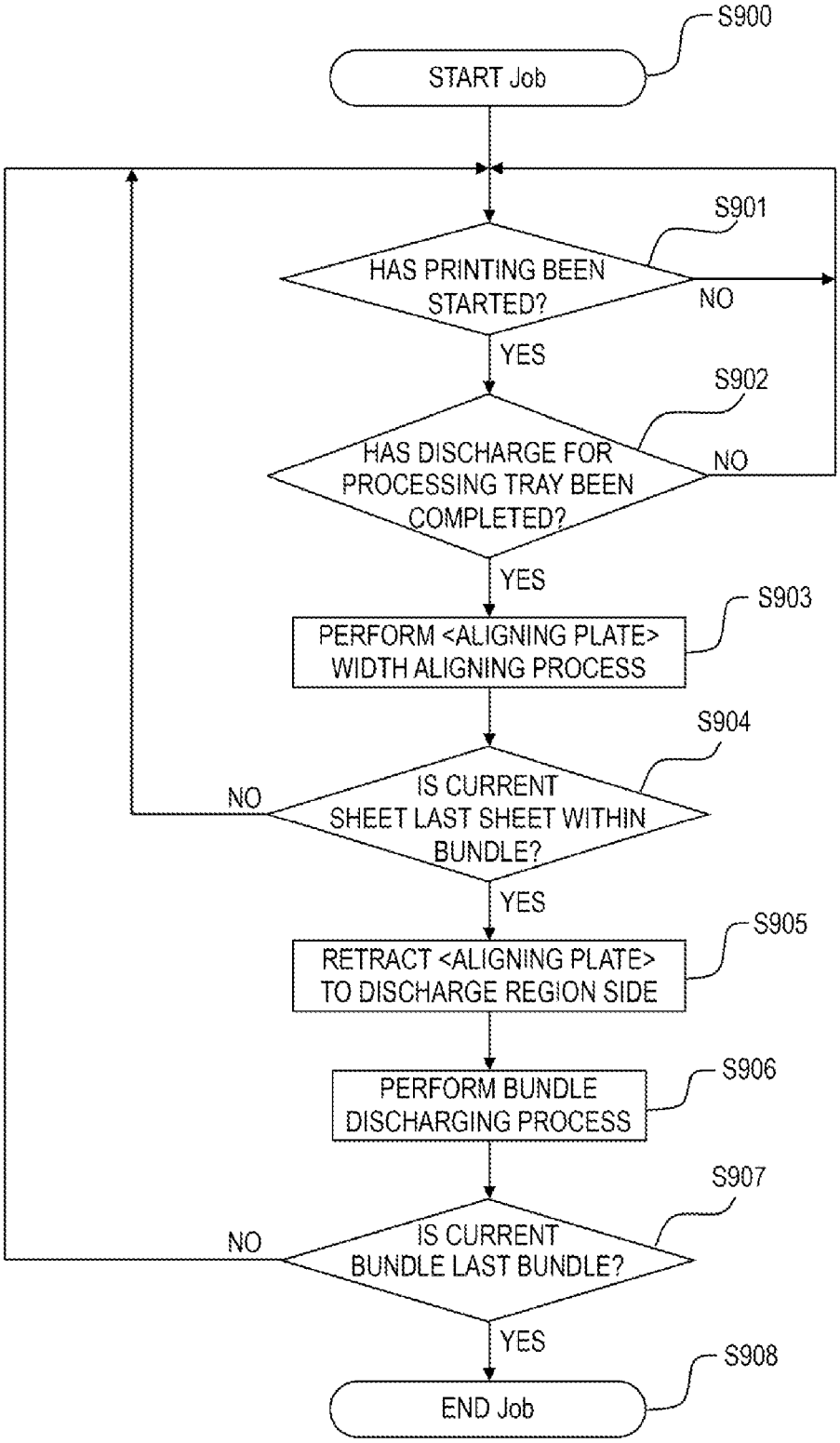
FIG. 15 is a flowchart that illustrates an aligning process performed by the finisher.

(Sheet Discharge Control) Next, a sheet sorting operation performed by the finisher 100 will be described along the flowchart represented in FIG. 15. FIG. 15 is a flowchart that illustrates an aligning process performed by the finisher 100 at the time of executing a print job of the image forming apparatus 900.

For example, when a sorting process is selected by using the operation portion 210, as illustrated in FIG. 15, after an initial operation of the image forming apparatus 900 is performed, the above-described image forming process (printing) is started in Step S900. When the image forming process (printing) ends in Step S901, and the discharge of the sheet to the processing tray 107 is completed in Step S902, the front-side aligning member 109*a* is moved to the position C shifted from the sheet discharge position to the front side and is caused to stand by. Then, the rear-side aligning member 109*b* is moved in the direction of the front-side aligning member 109*a* so as to collide with the sheet and is moved up to the position D, whereby the aligning process of the sheet in the width direction is performed in Step S903. When the sheet discharged to the processing tray is the last sheet within the bundle in Step S904, in the state in which the front-side aligning member 109*a* is caused to stand by at the position C shifted from the sheet discharge position to the front side, the rear-side aligning member 109*b* is moved to the standby position E outside the sheet discharge range 231. Then, the aligning members are caused to stand by until the aligning of the next sheet in Step S905.

Thereafter, the sheet bundle P' disposed on the processing tray 107 is discharged to the stack tray 504 in Step S906, and, in a case where the sheet bundle is not the last sheet bundle, a print job of the next sheet bundle is executed (No in Step S907). The next sheet bundle is aligned at a position shifted to the rear side of the previous sheet bundle. This operation is repeated up to the last sheet bundle, and when the current sheet bundle is the last sheet bundle (Yes in Step S907), the job ends in Step S908.

As described above, according to this embodiment, before the sheet bundle disposed on the processing tray 107 is discharged to the stack tray 504 by the discharge belts 251A and 251B, the aligning member 109*b* disposed within the sheet discharge range 231 out of the pair of aligning members that are in the state of nipping the sheet bundle therebetween is moved to the standby position that is outside the sheet discharge range. Accordingly, the operation of discharging the next sheet to the processing tray 107 and the operation of aligning the discharged sheet bundle can be efficiently performed, whereby the operation efficiency of the sheet processing apparatus and the apparatus main body supplying a sheet thereto can be improved.

In the above-described embodiment, as the timing for moving the aligning member that is disposed within the sheet discharge range out of the pair of aligning members that are in the state of nipping the sheet bundle therebetween to the outside of the sheet discharge range, while timing before the sheet bundle disposed on the processing tray 107 is discharged to the stack tray 504 has been described as an example, the present invention is not limited thereto. For example, as long as it is before the front end of the next sheet enters the processing tray 107, as the above-described timing, timing during the discharge of the sheet bundle disposed on the processing tray 107 that is performed by the bundle discharge portion may be set. Also by employing such a configuration, the same advantages as those of the above-described embodiment can be acquired.

In addition, in the above-described embodiment, while the printer has been described as an example of the image forming apparatus, the present invention is not limited thereto. For example, the image forming apparatus may be other types of image forming apparatus such as a copying machine and a facsimile machine, or yet other types of image forming apparatus such as a multi-function printer that has the combined functions of the copying machine and facsimile machine. By applying the present invention to a sheet processing apparatus included in such an image forming apparatus, the same advantages can be acquired.

Furthermore, in the above-described embodiment, while the sheet processing apparatus that is integrally included in the image forming apparatus has been described as an example, the present invention is not limited thereto. For example, a sheet processing apparatus that is freely detachably attachable to the image forming apparatus may be used, and, by applying the present invention to such a sheet processing apparatus, the same advantages can be acquired.

While the present invention has been described with reference to exemplary embodiments, it is to be understood that the invention is not limited to the disclosed exemplary embodiments. The scope of the following claims is to be accorded the broadest interpretation so as to encompass all such modifications, equivalent structures and functions.

This application claims the benefit of Japanese Patent Application No. 2013-122652, filed Jun. 11, 2013, which is hereby incorporated by reference herein in its entirety.

What is claimed is:

1. A sheet processing apparatus comprising:

a discharge portion configured to discharge a sheet;

a first stacking portion on which the sheet discharged by the discharge portion is stacked, wherein the sheet is discharged from the discharge portion onto the first stacking portion within a sheet discharge range;

a pair of aligning members configured to move in a width direction, perpendicular to a discharge direction of the sheet, and to align the sheet on the first stacking portion in the width direction;

a bundle discharge portion configured to discharge a sheet bundle having a plurality of sheets on the first stacking portion by pushing an end of the sheet bundle in the discharge direction;

a second stacking portion on which the sheet bundle discharged by the bundle discharge portion is stacked; and a controller configured to control operation of the pair of aligning members such that (a) the sheet bundle disposed on the first stacking portion is aligned by the pair of aligning members at a position shifted to a side of one aligning member of the pair of aligning members in the width direction with respect to the sheet discharge range, (b) after the pair of aligning members aligns the sheet bundle, the other aligning member of the pair of aligning members moves out from the sheet discharge range in the width direction, and (c) with the other aligning member of the pair of aligning members being positioned at the outside of the sheet discharge range in the width direction, the aligned sheet bundle is discharged by the bundle discharge portion to the second stacking portion, while the sheet bundle is regulated by the one aligning member of the pair of aligning members, without contacting the other aligning member that has moved outside of the sheet discharge range.

2. The sheet processing apparatus according to claim 1, wherein the controller is configured to move the other aligning member to the outside of the sheet discharge range for preventing the next sheet discharged by the discharge portion from contacting with the other aligning member.

3. The sheet processing apparatus according to claim 1, wherein the controller is configured to move the other aligning member to the outside of the sheet discharge range while the bundle discharge portion is conveying the sheet bundle to the second stacking portion, and with the other aligning member being positioned at the outside of the sheet discharge range, the aligned sheet bundle is discharged by the bundle discharge portion to the second stacking portion.

4. The sheet processing apparatus according to claim 1, wherein the bundle discharge portion is configured to be disposed at a center portion of the sheet discharge range of the discharge portion in the width direction and to discharge the sheet bundle by pushing the end of the sheet bundle disposed on the first stacking portion.

5. The sheet processing apparatus according to claim 4, wherein the bundle discharge portion is disposed to be horizontally symmetric with respect to the center of the sheet discharge range in the width direction.

6. The sheet processing apparatus according to claim 1, wherein the bundle discharge portion is configured to discharge the sheet bundle by pushing the end of the sheet bundle that is disposed on the side of the other aligning member rather than the center of the end of the sheet bundle in the width direction.

7. The sheet processing apparatus according to claim 1, wherein the one aligning member is configured to guide the sheet bundle discharged to the second stacking portion by the bundle discharge portion.

8. The sheet processing apparatus according to claim 1, wherein the controller is configured to move the other aligning member to the outside of the sheet discharge range before the bundle discharge portion starts conveying the sheet bundle toward the second stacking portion, and with the other aligning member being positioned at the outside of the sheet discharge range, the aligned sheet bundle is discharged by the bundle discharge portion to the second stacking portion.

9. The sheet processing apparatus according to claim 1, wherein after the pair of aligning members aligns the sheet bundle, the one aligning member of the pair of aligning members does not move until the sheet bundle is discharged by the bundle discharge portion.

10. An image forming apparatus comprising:

an image forming portion configured to form an image on a sheet;

a discharge portion configured to discharge a sheet on which the image is formed by the image forming portion;

a first stacking portion on which the sheet discharged by the discharge portion is stacked, wherein the sheet is discharged from the discharge portion onto the first stacking portion within a sheet discharge range;

a pair of aligning members configured to move in a width direction perpendicular to a discharge direction of the sheet and align the sheet on the first stacking portion in the width direction;

a bundle discharge portion configured to discharge a sheet bundle having a plurality of sheets on the first stacking portion by pushing an end of the sheet bundle in the discharge direction;

a second stacking portion on which the sheet bundle discharged by the bundle discharge portion is stacked; and a controller configured to control operation of the pair of aligning members such that (a) the sheet bundle disposed on the first stacking portion is aligned by the pair of aligning members at a position shifted to a side of one aligning member of the pair of aligning members in the width direction with respect to the sheet discharge range, (b) after the pair of aligning members aligns the sheet bundle, the other aligning member of the pair of aligning members moves out from the sheet discharge range in the width direction, and (c) with the other aligning member of the pair of aligning members being positioned at the outside of the sheet discharge range in the width direction, the aligned sheet bundle is discharged by the bundle discharge portion to the second stacking portion, while the sheet bundle is regulated by the one aligning member of the pair of aligning members, without contacting the other aligning member that has moved outside of the sheet discharge range.

11. The image forming apparatus according to claim 10, wherein the controller is configured to move the other aligning member to the outside of the sheet discharge range for preventing the next sheet discharged by the discharge portion from contacting with the other aligning member.

12. The image forming apparatus according to claim 10, wherein the controller is configured to move the other aligning member to the outside of the sheet discharge range while the bundle discharge portion is conveying the sheet bundle to the second stacking portion, and with the other aligning member being positioned at the outside of the sheet discharge range, the aligned sheet bundle is discharged by the bundle discharge portion to the second stacking portion.

13. The image forming apparatus according to claim 10, wherein the bundle discharge portion is configured to be disposed at a center portion of the sheet discharge range of the discharge portion in the width direction and to discharge the sheet bundle by pushing the end of the sheet bundle disposed on the first stacking portion.

14. The image forming apparatus according to claim 13, wherein the bundle discharge portion is disposed to be horizontally symmetric with respect to the center of the sheet discharge range in the width direction.

15. The image forming apparatus according to claim 10, wherein the bundle discharge portion is configured to discharge the sheet bundle by pushing the end of the sheet bundle that is disposed on the side of the other aligning member rather than the center of the end of the sheet bundle in the width direction.

16. The image forming apparatus according to claim 10, wherein the one aligning member is configured to guide the sheet bundle discharged to the second stacking portion by the bundle discharge portion.

17. The image forming apparatus according to claim 10, wherein the controller is configured to move the other aligning member to the outside of the sheet discharge range before the bundle discharge portion starts conveying the sheet bundle toward the second stacking portion, and with the other aligning member being positioned at the outside of the sheet discharge range, the aligned sheet bundle is discharged by the bundle discharge portion to the second stacking portion.

18. The image forming apparatus according to claim 10, wherein after the pair of aligning members aligns the sheet bundle, the one aligning member of the pair of aligning members does not move until the sheet bundle is discharged by the bundle discharge portion.

* * * * *